US005295593A

United States Patent [19]

Sturm

[11] Patent Number: 5,295,593

[45] Date of Patent: Mar. 22, 1994

[54] STORAGE AND DISPENSING UNIT

[75] Inventor: Michael R. Sturm, Mequon, Wis.

[73] Assignee: DCI Marketing, Milwaukee, Wis.

[21] Appl. No.: 816,492

[22] Filed: Dec. 31, 1991

[51] Int. Cl.[5] ..... A47F 1/04

[52] U.S. Cl. ..... 211/59.4; 206/429; 206/431; 220/908; 211/74; 248/98

[58] Field of Search ..... 211/59.4, 76, 187, 74, 211/59.2, 59.3; 220/908; 206/429, 431; 221/289, 312 R, 312 C; 248/98

[56] References Cited

U.S. PATENT DOCUMENTS

| | | | |
|---|---|---|---|
| 1,340,660 | 5/1920 | Lidberg | 211/76 X |
| 2,412,873 | 12/1946 | Cosley | 211/74 |
| 2,710,694 | 6/1955 | Carr | 211/76 |
| 2,723,037 | 11/1955 | Matesic | 211/74 |
| 3,847,457 | 11/1974 | Kleppin | 312/100 |
| 4,143,792 | 3/1979 | Rex | 221/97 |
| 4,318,485 | 3/1982 | Clement | 211/59.2 |
| 4,411,367 | 10/1983 | Bustos | 211/187 |
| 4,759,470 | 7/1988 | Jacobs | 221/97 |
| 4,796,763 | 1/1989 | Franklin et al. | 211/194 X |
| 4,948,004 | 8/1990 | Chich | 220/1 T |
| 5,035,323 | 7/1991 | Daniels et al. | 206/429 X |
| 5,088,750 | 2/1992 | Beese et al. | 220/908 X |
| 5,143,229 | 9/1992 | La Corte | 211/71 |

*Primary Examiner*—David A. Scherbel
*Assistant Examiner*—Korie Chan
*Attorney, Agent, or Firm*—Michael, Best & Friedrich

[57] ABSTRACT

Storage and dispensing unit comprising, in combination, wall structure defining an enclosure having outer walls, holding structure for supporting one or more containers in generally exposed condition on the outer facing walls, the holding structure including a first generally horizontal surface connected to the outer wall and offset laterally therefrom to define a shelf, a second generally horizontal surface in opposed relation to and spaced vertically from the first surface, structure defining an aperture in the second surface, and guide structure connecting the second surface to the outer wall for movement relative to the first surface, the guide structure providing a confined path of movement so that the second surface is movable toward and away from the first surface, whereby a container placed on the first surface extends upward into the aperture when the second surface is in its lowermost position and the container is free of the aperture when the second surface is in its uppermost position.

10 Claims, 2 Drawing Sheets

Fig. 5
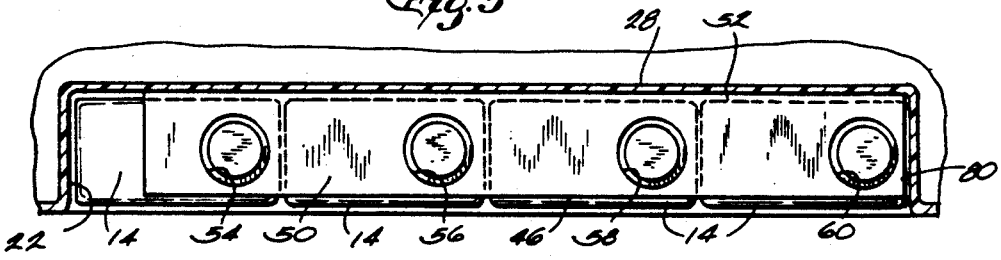
Fig. 4
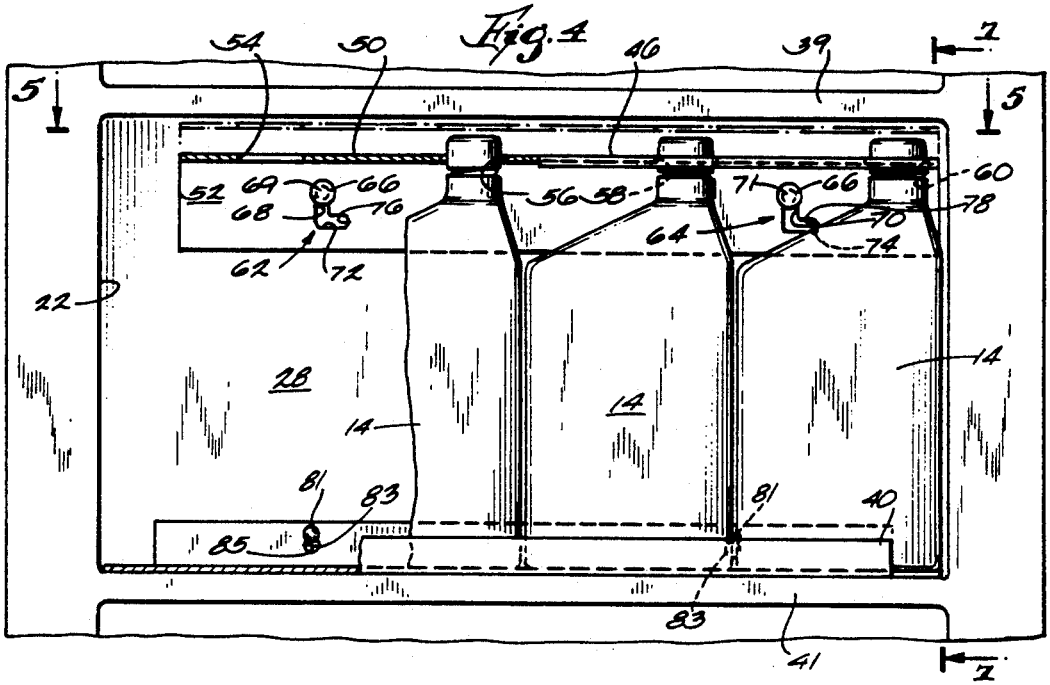
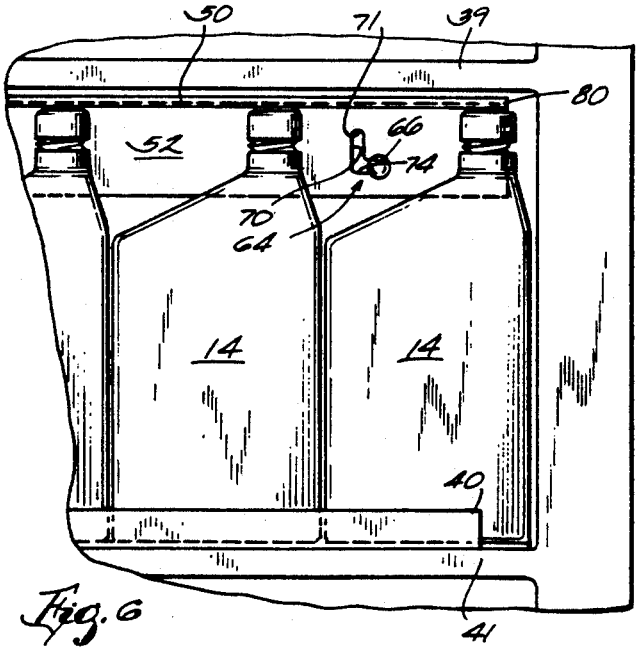
Fig. 6
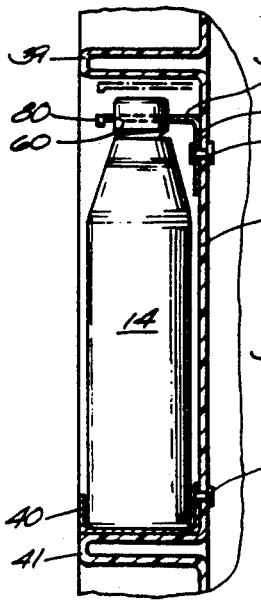
Fig. 7

STORAGE AND DISPENSING UNIT

BACKGROUND OF THE INVENTION

This invention relates to units of the type used at automobile service stations to store and dispense automotive products.

It has become accepted practice to provide convenience units at service stations. Such units contain commonly used supplies and utensils, and are readily accessible, for example, in the vicinity of the fuel pumping stations. Added versatility and capacity is continually strived for in these types of units. But such goals should be achieved with due regard for securely storing the items to be dispensed.

SUMMARY OF THE INVENTION

Among the objects of this invention is to provide a versatile, mobile service station which securely stores supplies but in a manner which has those supplies conveniently accessible for use.

For the achievement of these and other objects, this invention contemplates a storage and dispensing unit having outer facing walls in which holding means is provided for supporting one or more containers in a generally exposed condition in the unit. The holding means includes a first generally horizontal surface at the outer wall and offset laterally therefrom to define a shelf, and also includes a second generally horizontal surface in opposed relation to and spaced vertically from the first surface. The second surface is suitably apertured, and is suitably connected at the outer wall for movement relative to the first surface in a confined path of movement and toward and away from the first surface. The surfaces are arranged such that a container placed on the first surface extends upward into the aperture when the second surface is in its lowermost position and the container is free of the aperture when the second surface is in its uppermost position.

Preferably, a pin and slot arrangement connects the second surface at the outer wall with the slot having interconnected horizontal and vertical portions. Either the pin or the slot is connected to the outer wall and the other is connected to the second surface. Also, it is preferred to provide a plurality of apertures in the second surface, one aperture accommodating one container.

Other objects and advantages will be pointed out in, or be apparent from, the specification and claims, as well as obvious modifications of the embodiment shown in the drawings, in which:

FIG. 4 is an enlarged, elevation of the container storage rows;

FIG. 5 is a section view taken along line 5—5 in FIG. 4;

FIG. 6 is a further enlargement of a part of FIG. 4 with the collar moved to the container released position; and FIG. 7 is a section view taken along line 7—7 in FIG. 4 and showing the collar in its released and holding positions.

DESCRIPTION OF THE PREFERRED EMBODIMENT

Figure 1:
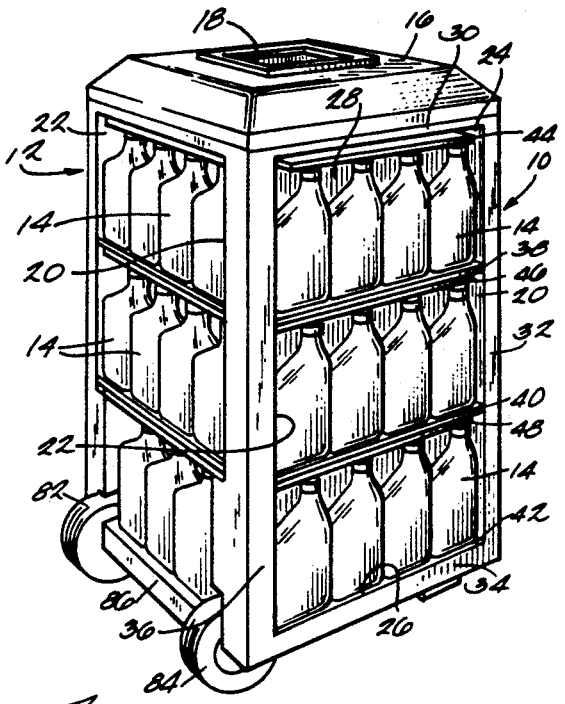
FIG. 1 is a perspective of a unit embodying this invention.

The preferred embodiment illustrated in the drawing, is a four-sided free standing unit. Three of the sides are identically constructed, two of these sides, 10 and 12, are visible in FIG. 1. Each of these sides are configured to store and display containers 14. These containers are preferably quarts of automotive oil, but could be other products. The construction of the three sides will be described in connection with only one, 10, it being appreciated that the description is applicable as well to the other two. However, before specifically describing that feature, the general construction of the unit will be described.

The unit is molded of a suitable synthetic material, such as high density polyethylene. The unit is hollow with outer vertical walls defining the sides referred to above. It has a quadrilateral (square) shape in horizontal cross-section and is elongated vertically.

A cover 16 rests on the top of the unit and is removable to permit access to the unit interior. A conventional plastic trash bag (not shown) is suitably hung in unit. Cover 16 includes a central opening 18 through which items to be discarded can be dropped into the trash bag. Removal of the cover 16 allows a full trash bag to be removed and replaced by a clean, empty bag.

Returning now to the construction of the oil quart storage sides, the outer wall is recessed defining opposed vertical walls 20 and 22, opposed horizontal walls 24 and 26, and a recessed wall portion 28 offbet laterally inward from surfaces 30, 32, 34 and 36 which define the outer extremity of what would otherwise be the outer wall.

Three shelf members 38, 40 and 42 are connected to wall portion 28. These members are generally parallel and spaced vertically in the recessed area. Also, they are positioned above and in engagement with ledges which are molded as part of the basic housing of the unit, two such ledges 39 and 41 are visible in FIGS. 4, 6, and 7.

Three container collars 44, 46, and 48 are also arranged in the recessed area. One of the collars is associated with each of the shelves 38, 40 and 42. More particularly, each collar has a central web 50 and a flange 52. Flange 52 is attached to web 50 and extends generally perpendicular from the web. Adjacent shelf members and collars define storage rows and, in the illustrated embodiment, four containers are supported in each the row defined by a shelf and an opposed collar. Correspondingly, the collars are provided with four apertures 54, 56, 58 and 60. The upper necks of the containers extend into the collar apertures so that they, the containers, are held securely in the unit. The opening for accommodating the upper container necks could be a continuous hole. The individual openings are preferred, however, because that arrangement holds the containers stationary even when less than a full compliment, four, of the containers are arranged in the row. That is, as one or more are removed, the remainder are still held securely against spilling out of the unit when the collar is down.

To provide for selective removal of the containers, the collars are connected to the recessed outer wall for movement relative to the shelves. With reference to FIGS. 5-7, one of the collars is illustrated. Two L-shaped slots 62 and 64 are spaced apart on flange 52. Headed pins 66 are connected to the wall and extend into slots 62 and 64. The engagement between the slots and pins is relatively loose so that the collar can be moved readily on the pin. With this arrangement, the collar can be raised up and out of engagement with container necks to release the containers for removal, preferably and for reasons that will be explained hereinafter, the movement has a vertical and horizontal component. Specifically, in the normal engaged position, the upper ends 69 and 71 of vertical legs 68 and 70 of the slots 62 and 64 rest on pins 66. To release the containers, the collar is grasped and raised on the pin until the pin aligns with horizontal legs 72 and 74. The collar is then moved horizontally to position the pins with legs 72 and 74, and preferably at ends 76 and 78. The vertical movement of the collar frees the containers, the horizontal component of the movement places the leg portions 72 and 74 on the pins so that the collar can be released and will remain in the raised position. A lip 80 is provided on each collar to provide a better grip for manipulating the collar. Similarly, an upwardly turned lip 100 is provided on shelves 38, 40 and 42 to better hold the containers in place.

The shelves 38, 40, and 42 are removably connected to wall 28 by pins 81 and 83, one such combination visible in FIGS. 4 and 7. In a conventional manner slot 83 has a reduced width upper portion (not specifically illustrated) and an enlarged, circular end 85. Normally, the end of reduced width portion rests on the pin. The shelf can be raised to register the enlarged end 85 with the head of pin 81 for movement over the pin so that the shelf can be removed.

The dispensing unit is provided with wheels 82 and 84 at two lower corners to facilitate movement of the unit from internal storage to external use, or from desired location to desired location once outside. The wheels are supported on an elongated axle mounted below and within shelf 86. The storage row in the area of the wheels is shorter as compared to the others in order to accommodate the wheels. Only three containers are arranged in that row.

Figure 2:
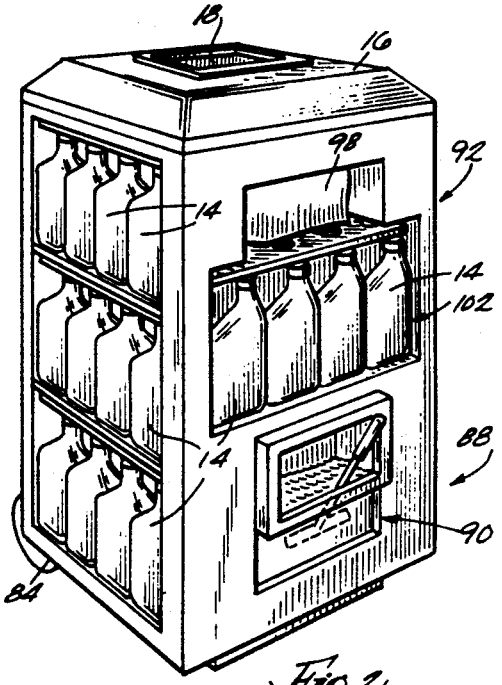
FIG. 2 is a perspective of the unit from another angle.
Figure 3:
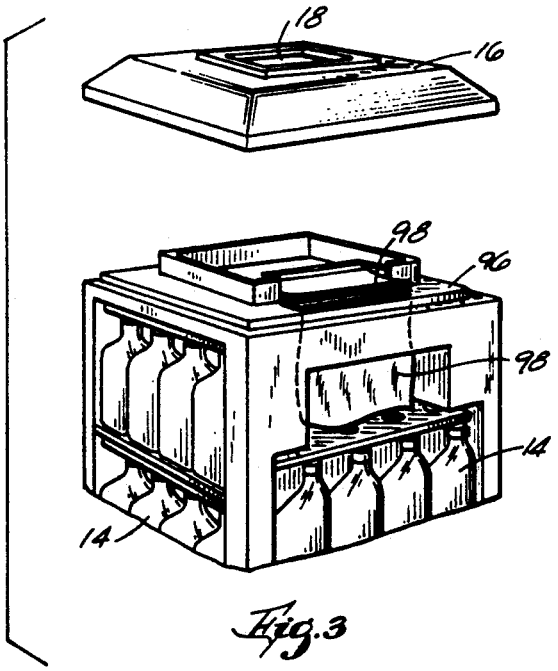
FIG. 3 is a partial view of the upper portion of the unit with the cover removed to expose a part of one of the convenience modules.

To complete the description of the unit attention will now be directed to FIGS. 2 and 3 and side 88 of the unit. This side includes a liquid compartment 90 for holding windshield cleaning liquid and utensils. Also, a towel dispenser 92 is provided above the liquid compartment. A single container storage row 102 is provided between the liquid compartment and towel dispenser. The liquid compartment and towel dispenser are of conventional construction, but it will be noted that they are in the wall opposite to that from which the wheels are supported. To move the unit, it can be grasped at the recessed area of the towel dispenser or that of the liquid compartment to tilt the unit onto the wheels. In that position, it can be moved on the wheels to any desired location.

With reference to FIG. 3, it will be also noted the top wall 96, which is exposed when cover 16 is removed, has a recessed area into which the towels 98 are loaded to be exposed at the recess area 94 for individual removal of the towels.

Although but one embodiment of the present invention has been illustrated and described, it will be apparent to those skilled in the art that various changes and modifications may be made therein without department from the spirit of the invention or from the scope of the appended claims.

I claim:

1. Storage and dispensing unit comprising, in combination, wall means defining an enclosure having a wall, holding means for supporting one or more containers in generally exposed condition on said wall, said holding means including a first generally horizontal surface connected to said wall and offset laterally outwardly therefrom to define a shelf, a second generally horizontal surface in opposed relation to and spaced vertically from said first surface, means defining at least an aperture in said second surface, guide means connecting said second surface to said wall for movement relative to said first surface and relative to a container placed on said first surface, said guide means providing a confined path of movement so that said second surface is movable toward and away from said first surface and said container, said confined path of movement has a generally horizontal and a generally vertical component, and when said second surface is moved away from said first surface, said second surface is displaceable horizontally relative to the first surface, and whereby said container placed on said first surface extends upward into said aperture when said second surface is in its lowermost position and said container is free of said aperture when said second surface is in its uppermost position.

2. The combination of claim 1 wherein said guide means comprises a pin and a slot, one of said pin and said slot being on said wall and the other of said pin and said slot being on said second surface, and wherein said slot has interconnected vertical and horizontal portions.

3. The combination of claim 2 including a lip on said first surface extending vertically toward and terminating in spaced relation from said second surface.

4. The combination of claim 3 wherein a plurality of spaced apertures are defined in said second surface.

5. Storage and dispensing unit comprising, in combination, wall means defining a housing having an interior space having a cross-sectional shape which is generally polygonal, holding means for supporting one or more containers in generally exposed condition on said housing, said holding means including a first generally horizontal surface connected to said housing and offset laterally outwardly therefrom to define a shelf, a second generally horizontal surface in opposed relation to and spaced vertically from said first surface, means defining at least one aperture in said first surface, and guide means having a pin and a slot connecting said second surface to said housing for movement relative to said first surface and relative to a container placed on said first surface, said pin and said slot providing a confined path of movement so that said second surface is movable toward and away from said first surface and said container on said first surface, said confined path of movement has a generally horizontal and a generally vertical component, and when said second surface is moved away from said first surface, said second surface is displaceable horizontally relative to the first surface, and whereby said container placed on said first surface extends upward into said aperture when said second surface is in its lowermost position and said container is free of said aperture when said second surface is in its uppermost position.

6. The combination of claim 5 wherein one of said pin and said slot is on said housing and the other of said pin and said slot is on said second surface, and wherein said slot has interconnected vertical and horizontal portions.

7. The combination of claim 6 including a lip on said first surface extending vertically toward and terminating in spaced relation from said second surface.

8. The combination claim 5 including a recessed area in said housing, wheel means, and means supporting said wheels on the lower edge of said housing which is opposite that in which said recessed area is provided.

9. The combination of claim 5 wherein a plurality of spaced apertures are defined in said second surface.

10. The combination of claim 5, wherein said first horizontal surface comprises a shift member, and wherein said guide means connects said shift member to said housing.

* * * * *